US007131814B2

(12) United States Patent
Nagler et al.

(10) Patent No.: US 7,131,814 B2
(45) Date of Patent: Nov. 7, 2006

(54) COOLING ARRANGEMENT

(75) Inventors: Christoph Nagler, Zurich (CH); André Schwind, Crottendorf (DE); Ralf Walz, Heiligenzell (DE)

(73) Assignee: Alstom Technology Ltd., Baden (CH)

( * ) Notice: Subject to any disclaimer, the term of this patent is extended or adjusted under 35 U.S.C. 154(b) by 118 days.

(21) Appl. No.: 10/762,293

(22) Filed: Jan. 23, 2004

(65) Prior Publication Data

US 2005/0089396 A1 Apr. 28, 2005

(30) Foreign Application Priority Data

Jan. 29, 2003 (DE) ..... 103 03 340

(51) Int. Cl.
*F01D 11/00* (2006.01)

(52) U.S. Cl. ..... 415/116; 415/136; 415/173.1

(58) Field of Classification Search ..... 415/116, 415/173.1, 173.4, 174.3, 136, 214.1, 117, 415/115; 416/189; 277/930
See application file for complete search history.

(56) References Cited

U.S. PATENT DOCUMENTS 3,300,178 A * 1/1967 Rizk et al. ..... 415/115
4,199,151 A * 4/1980 Bartos ..... 277/306
4,565,492 A * 1/1986 Bart et al. ..... 415/175
5,165,847 A * 11/1992 Proctor et al. ..... 415/115
6,126,390 A * 10/2000 Bock ..... 415/115
6,340,285 B1 * 1/2002 Gonyou et al. ..... 415/116
6,491,093 B1 * 12/2002 Kreis et al. ..... 165/169

* cited by examiner

*Primary Examiner*—Edward K. Look
*Assistant Examiner*—Nathan Wiehe
(74) *Attorney, Agent, or Firm*—Cermak & Kenealy, LLP; Adam J. Cermak

(57) ABSTRACT

A cooling arrangement (17) for supplying a first cavity (9) with a cooling gas, in particular in a gas turbine of a power plant, includes a cooling-gas passage (19) which is formed in a first component (6) and connects the first cavity (9) to a second cavity (10 ). A second component (16 ) bears against a bearing side (15) remote from the second cavity (10 ) and separates the first cavity (9) from a third cavity (12). The second component (16 ) is displaceable within a range of displacement. To improve the cooling effect, an orifice region (20) of the cooling-gas passage (19) is dimensioned and/or positioned in such a way that its orifice cross section (21) projects from the range of displacement to such an extent that it is open at least with a predetermined minimum cross section in any position of the second component (16 ).

13 Claims, 3 Drawing Sheets

COOLING ARRANGEMENT

TECHNICAL FIELD

The present invention relates to a cooling arrangement for the admission of a cooling gas to a first cavity, in particular in a gas turbine of a power plant.

PRIOR ART

In many applications, it is necessary for a component which is exposed to a high thermal load on a first side to be cooled on its other side. For example, in a gas turbine, the hot combustion exhaust gases are admitted to a "heat shield" on the one side, and this heat shield is exposed to a cooling-gas flow on its other side. On the cooled side, the respective component may have a wall which serves, for example, for fastening purposes and which, at this cooled side, separates a first cavity from a second cavity. Whereas the second cavity is normally connected to a cooling-gas supply, the first cavity may be supplied with cooling gas from the second cavity via one or more cooling-gas passages. A further component, which in this case separates the first cavity from a third cavity, may bear against the wall of the first component on the side remote from the second cavity. For example, the third cavity then forms the hot-gas region of a gas turbine. This second component may be a further heat shield, a turbine blade or a seal.

In particular in a gas turbine, relative movements may occur between the two components. In the most unfavorable cases, the second component may come to lie in front of the orifice of the cooling-gas passage, as a result of which, firstly, the cooling-gas mass flow into the first cavity is reduced, so that an undesirable temperature increase may occur there. Secondly, an undesirable pressure drop may occur in the first cavity, as a result of which hot gases can enter the first cavity from the third cavity while bypassing the second component, a factor which likewise leads to an undesirable temperature increase in the second cavity.

The problem described can occur in particular in a gas turbine if the second component is a seal which is retained in its desired position by means of retaining bolts. During operation, vibrations may lead to the seal eating into the bolts. In the extreme case, the bolts may weaken as a result and may finally break off. The seal, which is then no longer retained, may move in front of the cooling-gas passage or passages. This is accompanied by an impairment in the cooling effect and by a pressure drop in the first cavity, a factor which may lead to an extremely high temperature increase in the first cavity within a short time.

SUMMARY OF THE INVENTION

The invention is intended to provide a remedy here. An aspect of the invention deals with the problem of specifying an improved embodiment for a cooling arrangement of the type mentioned at the beginning, this improved embodiment permitting a sufficient cooling-gas supply to the first cavity in particular during a variation in the relative position between the first component and the second component.

The invention is based on the general idea of adapting an orifice region, facing the first cavity, of the cooling-gas passage with regard to its dimensioning and/or positioning to a predetermined range of displacement within which the relative displacements between the two components take place as expected. By means of this type of construction, a sufficiently large orifice cross section can be provided for every possible relative position between the two components, so that a sufficient cooling-gas supply to the first cavity and also a sufficiently large pressure in the first cavity are always available. It is of particular importance in this case that the performance of the cooling arrangement can be improved by means of a measure which can be realized in a relatively simple and inexpensive manner.

The cooling-gas passage can have a predetermined nominal cross section outside its orifice region, this nominal cross section being smaller than the cross sections in the orifice region. This nominal cross section forms the narrowest and smallest cross section inside the cooling-gas passage. Accordingly, the cooling-gas mass flow through the cooling-gas passage and also the pressures in the first and the second cavity are defined by the nominal cross section at the nominal operating point of the cooling arrangement. According to a preferred development, the minimum cross section with which the orifice cross section is reliably opened in all the intended relative positions of the components can be the same size as or larger than this nominal cross section. Accordingly, this type of construction ensures that, in all the anticipated relative positions between the components, the cooling-gas mass flow through the cooling-gas passage and/or the pressure in the first and second cavities have/has the values intended for nominal operation.

The orifice region may in principle have any desired geometrical form which leads to an orifice cross section which is larger than the nominal cross section. In this case, geometries which are simple to produce are preferred. For example, the orifice region may be formed by a bevel which is provided on that end of the cooling-gas passage which faces the first cavity.

In another embodiment, in which a plurality of cooling-gas passages are provided, a groove may be formed in the wall on a bearing side facing the first cavity, this groove connecting the at least two cooling-gas passages to one another in such a way that the orifice regions of these cooling-gas passages are formed by the groove or merge into this groove. By the incorporation of such a groove, the orifice region according to the invention can at the same time be produced for a plurality of cooling-gas passages. The production of the first component provided with the cooling arrangement is simplified by this type of construction.

Further important features and advantages of the cooling arrangement according to the invention follow from the drawings and the associated description of the figures with reference to the drawings.

BRIEF DESCRIPTION OF THE DRAWINGS

Preferred exemplary embodiments of the invention are shown in the drawings and are described in more detail below, the same designations referring to the same or similar or functionally identical components. In the drawings, in each case schematically.

WAYS OF IMPLEMENTING THE INVENTION

Figure 1:
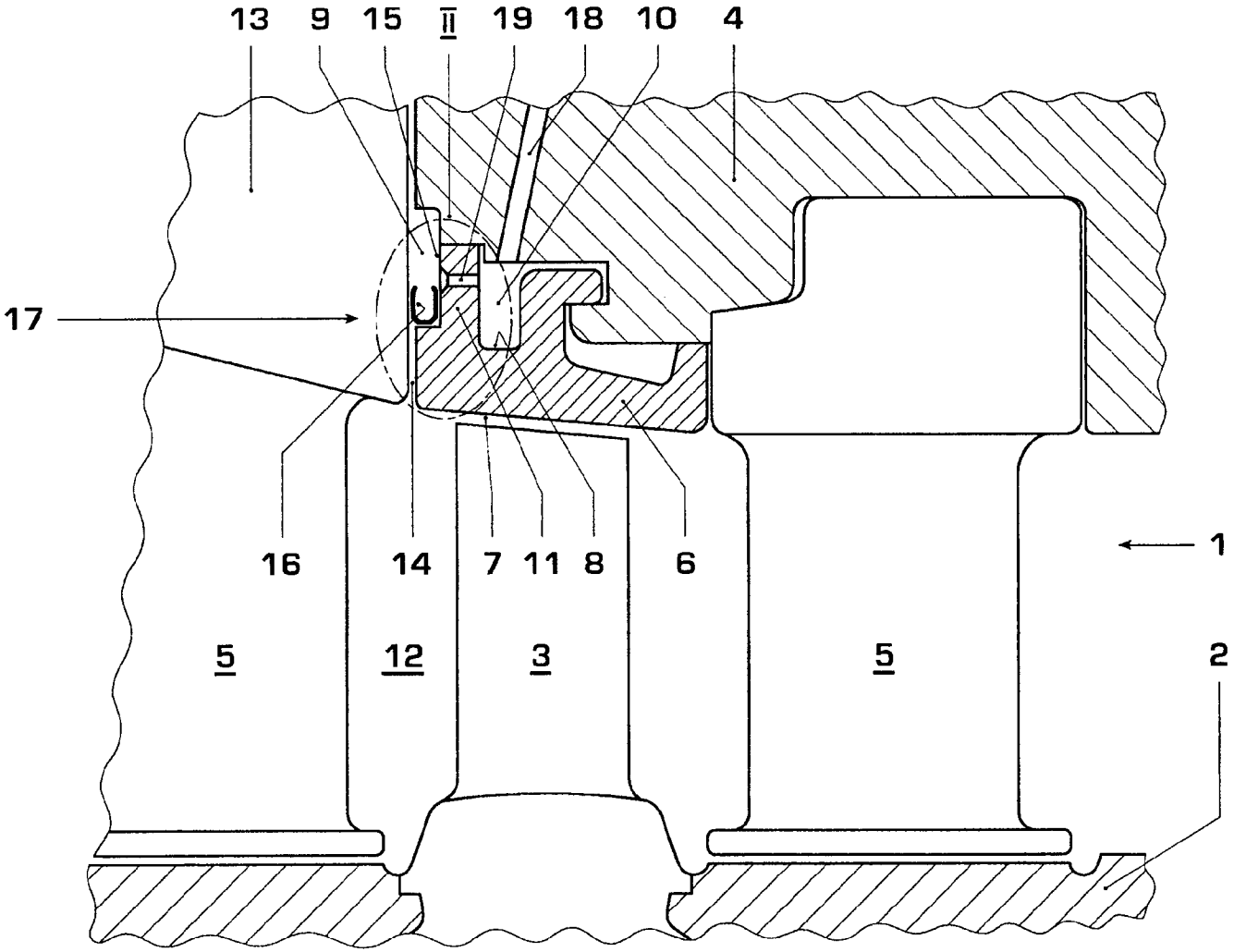
FIG. 1 shows a greatly simplified longitudinal section through a gas turbine in the region of a component provided with a cooling arrangement according to the invention.
Figure 2:
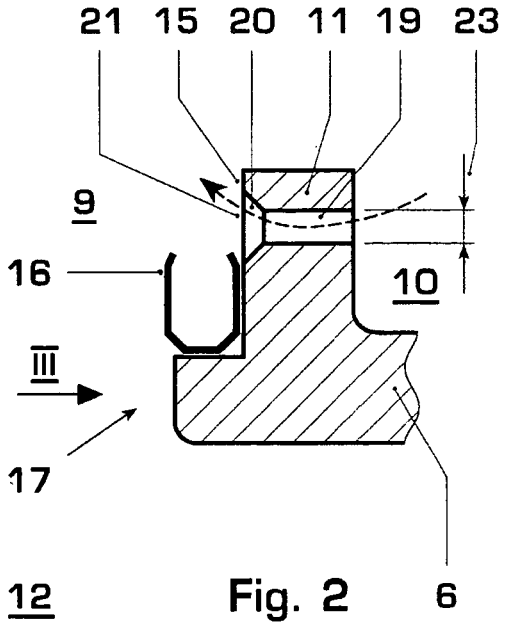
FIG. 2 shows a longitudinal section through a detail II in FIG. 1 on an enlarged scale and in a first relative position.
Figure 3:
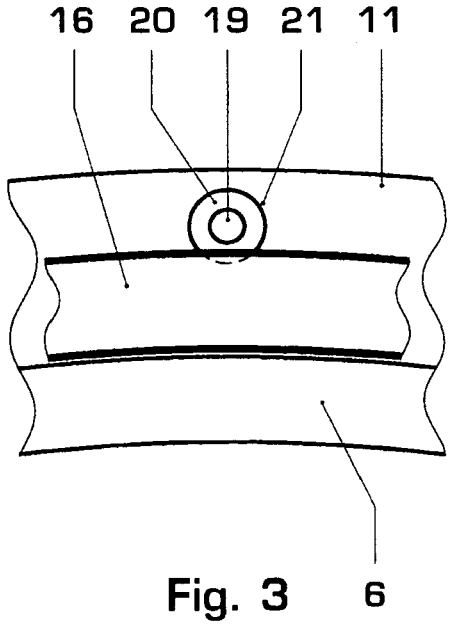
FIG. 3 shows a front view in accordance with the direction of view III toward the detail in FIG. 2.
Figure 4:
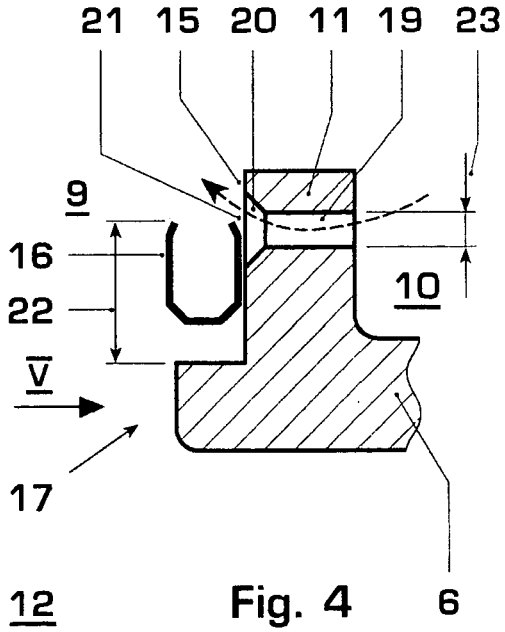
FIG. 4 shows a view as in FIG. 2 but in a second relative position.
Figure 5:
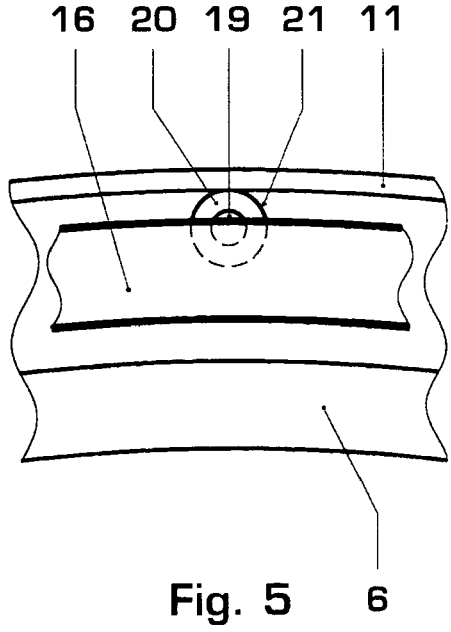
FIG. 5 shows a view as in FIG. 3 but in the second relative position.
Figure 6:
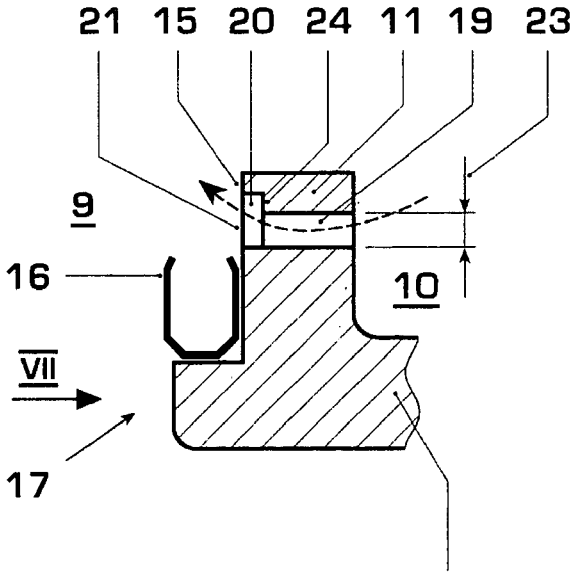
FIG. 6 shows a view as in FIG. 2 but in another embodiment.

According to FIG. 1 a gas turbine 1 (only partly shown), in particular of a power plant, contains a rotor 2 which is rotatably mounted about a rotor axis (not shown here) running parallel to the section plane. The rotor 2 carries moving blades 3, of which in FIG. 1, however, only one is shown by way of example. The rotor 2 rotates in a casing 4, which carries a plurality of guide blades 5, of which only two are shown here. The casing 4 carries a heat shield 6 between two moving blade rows, this heat shield 6 being radially adjacent to the one moving blade 3.

With regard to the rotor axis of the rotor 2, the heat shield 6 has an inner side 7 lying radially on the inside and an outer side 8 lying radially on the outside. Arranged on the outer side 8 of the heat shield 6 are a first cavity 9 and a second cavity 10, to which the outer side 8 of the heat shield 6 is exposed. In this case, the first cavity 9 and the second cavity 10 are separated from one another by a wall 11 which is formed on the heat shield 6 on the outer side 8 of the latter and extends in the circumferential direction.

On its inner side 7, the heat shield 6 is exposed to a third cavity 12, in which the blades 3, 5 are arranged and through which hot flow gases flow during operation of the gas turbine 1. Formed axially between the heat shield 6 and a blade root 13 of the adjacent guide blade 5 upstream is a gap 14, via which the first cavity 9 is connected to the third cavity 12. In order to seal this connection or this gap 14, a seal 16 is arranged on a bearing side 15, remote from the second cavity 10, of the wall 11, this seal 16 being supported axially on the bearing side 15 of the wall 11 on the one hand and on the blade root 13 on the other hand. The seal 16 therefore separates the first cavity 9 from the third cavity 12. Here, by way of example, the seal 16 has a U-shaped cross section. It is clear that, in principle, any other desired cross sections may also be used, such as, for example, a W-shaped cross section or a solid cross section or a disk-shaped cross section.

So that the heat shield 6 withstands the high thermal loads during operation of the gas turbine 1, a cooling arrangement 17 according to the invention is provided on the outer side 8 of the heat shield 6. In this cooling arrangement 17, a cooling gas is admitted to the second cavity 10 via a cooling-gas feed 18. Formed in the wall 11 is at least one cooling-gas passage 19 which connects the first cavity 9 to the second cavity 10 in a communicating manner. The wall 11 normally contains a plurality of such cooling-gas passages 19 distributed in the circumferential direction. Via the cooling-gas passage or passages 19, the cooling gas can enter the first cavity 9 from the second cavity 10 and cool the surfaces or components adjoining the first cavity 9.

The first cavity 9 is supplied with cooling gas through the cooling-gas passage or passages 19. At the same time, a predetermined pressure is formed in the first cavity 9, this pressure being expediently higher than the pressure in the third cavity 12. This ensures that no hot gas passes from the third cavity 12 into the first cavity 9 in the event of leakages.

During proper operation of the gas turbine 1, the seal 16 is located approximately in the position shown in FIG. 1, in which it does not impair the gas flow through the cooling-gas passage 19. In certain operating situations and/or in the event of (minor) damage, it may be the case that the seal 16 is displaced in the radial direction along the wall 11 within a predetermined range of displacement. In the process, the seal 16 may move in front of one or more cooling passages 19. So that the cooling effect is not impaired by this displacement movement of the seal 16, the cooling arrangement 17 is provided with the features according to the invention, which will be described in more detail below with reference to FIGS. 2 to 9.

According to FIGS. 2 to 9, the cooling-gas passage 19 is provided with an orifice region 20 which faces the first cavity 9 and has an orifice cross section 21 in the bearing side 15 of the wall 11.

This orifice region 20 is now dimensioned and/or positioned inside the wall 11 on the bearing side 15 in such a way that its orifice cross section 21 projects from the abovementioned range of displacement of the seal 16, to be precise to such an extent that the orifice cross section 21, in any desired position of the seal 16 within this range of displacement, cannot be completely covered by the seal 16 but rather always remains open at least with a predetermined minimum cross section. This minimum cross section is selected in such a way that a sufficient flow through the cooling-gas passage 19 can be ensured, so that a sufficient mass flow, on the one hand, and a sufficient pressure in the first cavity 9, on the other hand, can be provided.

In FIGS. 2, 3 and 6, 7, the seal 16 assumes a first extreme position within its range of displacement, in which position a minimum overlap with the orifice region 21 is obtained. This relative position exists under normal operating conditions of the gas turbine 1. FIGS. 4, 5 and 8, 9 show a second extreme position of the seal 16 within the range of displacement with maximum overlap of the orifice cross section 21. This relative position is obtained under special operating states or in the event of calculated damage, for example if a mounting of the seal 16 fails. The predetermined range of displacement of the seal 16 is symbolized in FIGS. 4 and 8 by a double arrow and designated by 22.

As can be seen from FIGS. 4, 5 and 8, 9, a sufficient cooling-gas flow can be maintained even during a maximum attainable overlap between seal 16 and cooling-gas passage 19. This is especially important for the operating reliability of the gas turbine 1.

Up to the orifice region 20, the cooling-gas passage 19 has a constant cross section, which is also designated below as nominal cross section 23.

This nominal cross section 23 is smaller than all the cross sections in the orifice region 20. At the nominal operating point of the gas turbine 1, the nominal cross section 23 defines the cooling-gas mass flow through the cooling-gas passage 19 and the pressure attainable in the first cavity 9. Furthermore, the pressure in the second cavity 10 is determined by the dimensioning of the nominal cross section 23. It is therefore not expedient for a proper operation of the cooling arrangement 17 to provide the entire cooling-gas passage 19 with the comparatively large orifice cross section 21. For example, the pressure drop in the second cavity 10 would then be too large.

In accordance with expedient dimensioning, the minimum cross section of the orifice cross section 21 which still remains open at maximum overlap of the seal 16 is selected to be so large that it is at least the same size as the nominal cross section 23. Accordingly, even in the event of an extreme displacement of the seal 16, the mass flow provided for the nominal operating point and also the associated pressure conditions in the first cavity 9 and in the second cavity 10 can be maintained.

In the embodiment in FIGS. 2 to 5, the cooling-gas passage 19 in the orifice region 20 widens toward the first cavity 9 until it reaches its orifice cross section 21. In other words: in the orifice region 20, the cooling-gas passage 19 narrows from the orifice cross section 21 down to the nominal cross section 23. This is achieved, for example, by means of a bevel subsequently provided.

In another embodiment, such as, for example, that shown in FIGS. 6 to 9, the cooling-gas passage 19 can merge into the orifice region 20 by means of an abrupt cross-sectional widening 24. In addition, the orifice region 20 in this case has a uniform cross section from this cross-sectional widening 24 up to the orifice cross section 21.

Figure 7:
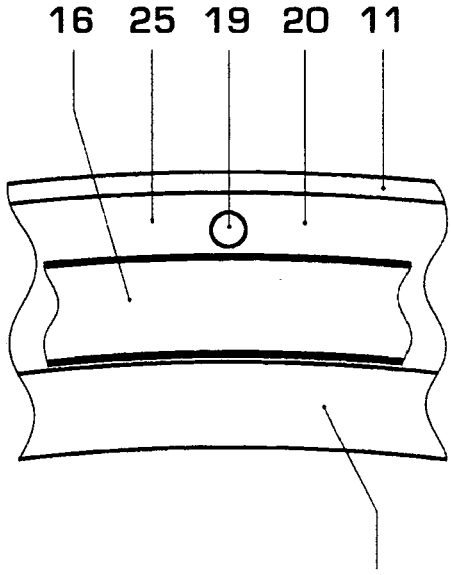
FIG. 7 shows a view as in FIG. 3 but in the other embodiment.
Figure 8:
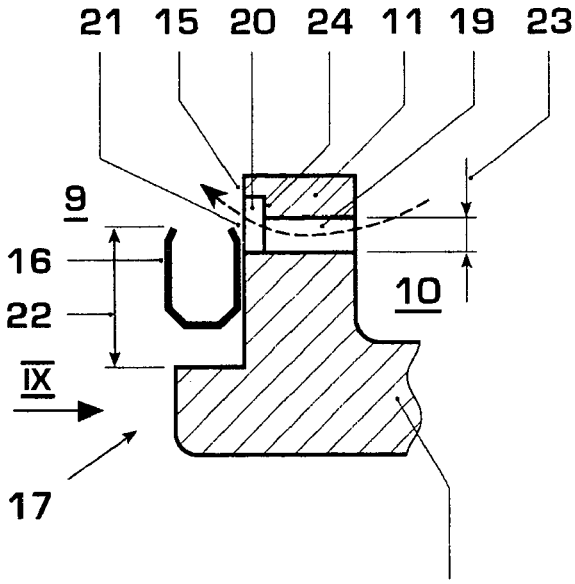
FIG. 8 shows a view as in FIG. 4 but in the other embodiment.
Figure 9:
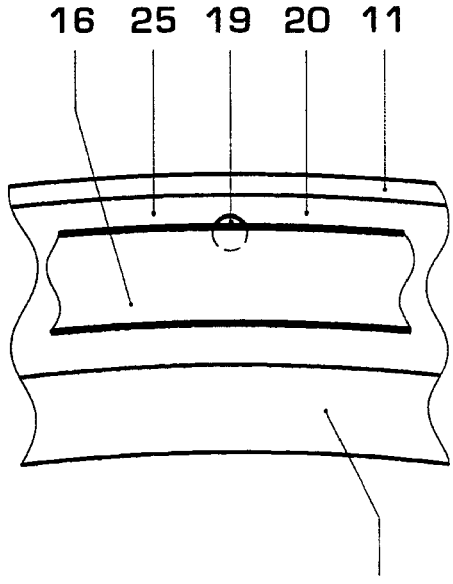
FIG. 9 shows a view as in FIG. 5 but in the other embodiment.

As can be seen in particular from FIGS. 7 and 9, the orifice region 20 can be produced by means of a groove 25 which is incorporated in the wall 11 on the bearing side 15 in such a way that the cooling-gas passage 19 opens into the groove bottom of the groove 25. That side of the groove 25 which is open toward the first cavity 9 then forms the orifice cross section 21 of the cooling-gas passage 19, which due to the length of the groove 25 can be configured so as to be many times larger than the nominal cross section 23.

Provided the wall 11 contains a plurality of cooling-gas passages 19, it is expedient to place the groove 25 in such a way that it runs across a plurality of cooling-gas passages 19, in particular across all the cooling-gas passages 19. As a result, the cooling-gas passages 19 connected to one another via the groove 25 have a common orifice region 20 of relatively large volume.

When dimensioning and positioning the orifice region 20, care is also expediently taken to ensure that no relative position in which the orifice cross section 21 is open toward the third cavity 12 or toward the gap 14 is obtained within the admissible range of displacement.

Here, the heat shield 6 forms a first component 6 on which the wall 11 for separating the first cavity 9 from the second cavity 10 is formed. The seal 16 bears against the bearing side 15 of this wall 11, which contains the cooling passage or passages 19, this seal 16 at the same time forming a second component 16 which separates the first cavity 9 from the third cavity 12 at the wall 11. Instead of the seal 16, the second component 16 may also be formed by another component. For example, the blade root 13 can come to bear directly against the bearing side 15 of the wall 11 and form the second component as a result. It is clear that the present invention is not restricted to a heat shield 6 but can in principle be applied to any other desired component with corresponding cooling arrangement 17.

LIST OF DESIGNATIONS

1 Gas turbine
2 Rotor
3 Moving blade
4 Casing
5 Guide blade
6 Heat shield/first component
7 Inner side of 6
8 Outer side of 6
9 First cavity
10 Second cavity
11 Wall
12 Third cavity
13 Blade root
14 Gap
15 Bearing side of 11
16 Seal/second component
17 Cooling arrangement
18 Cooling-gas feed
19 Cooling-gas passage
20 Orifice region of 19
21 Orifice cross section
22 Range of displacement
23 Nominal cross section
24 Cross-sectional widening
25 Groove

The invention claimed is:

1. A cooling arrangement for the admission of a cooling gas to a first cavity, comprising:

a first cavity, a second cavity spaced from the first cavity, and a third cavity spaced from the first cavity;

a first component having a wall separating the first cavity from the second cavity, the wall having a bearing side;

at least one cooling-gas passage arranged in said wall and communicatingly connecting the first cavity to the second cavity;

a second component bearing against the wall on the bearing side remote from the second cavity and separating the first cavity from the third cavity;

the second component being displaceable along the wall within a predetermined range of displacement;

the at least one cooling-gas passage including an orifice region facing the first cavity dimensioned, positioned, or both, so that an orifice cross section projects from the range of displacement at least to such an extent that the orifice region is open at least with a predetermined minimum cross section in any position of the second component within the range of displacement;

wherein the first component comprises a heat shield of a gas turbine, said heat shield, with respect to a rotation axis of a rotor of the gas turbine, being exposed radially on the inside to the third cavity and radially on the outside to the first cavity and to the second cavity;

wherein the wall projects radially outward from the heat shield;

wherein the wall extends in the circumferential direction;

wherein the at least one cooling-gas passage comprises a plurality of circumferentially distributed cooling-gas passages arranged in the wall;

a gap connecting the first cavity to the third cavity; and wherein the second component comprises a seal which bears against the wall of the heat shield and is configured and arranged to bear against a second heat shield or against a root of a guide blade of the gas turbine, and seals said gap.

2. The cooling arrangement as claimed in claim 1, wherein the cooling-gas passage has a predetermined nominal cross section outside said orifice region, the nominal cross section being smaller than the cross sections of the cooling-gas passage in the orifice region.

3. The cooling arrangement as claimed in claim 2, wherein outside the orifice region the cooling-gas passage cross-section is constant and is the nominal cross section.

4. The cooling arrangement as claimed in claim 2, wherein the minimum cross section is the same as or larger than the nominal cross section.

5. A cooling arrangement as claimed in claim 1, wherein the plurality of cooling-gas passages, in said orifice region, widen towards the first cavity up to the orifice cross section.

6. The cooling arrangement as claimed in claim 5, wherein the orifice region comprises a bevel.

7. The cooling arrangement as claimed in claim 1, wherein:

the cooling-gas passage further comprises an abrupt cross-sectional widening, and the cooling passage merges into said orifice region by the abrupt cross-sectional widening; and the cross section in the orifice region is constant from the cross-sectional widening up to the orifice cross section.

8. The cooling arrangement as claimed in claim 1, wherein said at least one cooling-gas passage comprises at least two cooling-gas passages; and further comprising a groove formed in the wall on the bearing side, the groove connecting the at least two cooling-gas passages to one another so that the orifice regions of said cooling-gas passages are formed by the groove or merge into the groove.

9. The cooling arrangement as claimed in claim 1, further comprising:

a third component comprising said second heat shield or said root of a guide blade of the gas turbine; and wherein said gap is formed between the first component and the third component.

10. The cooling arrangement as claimed in claim 1, wherein the positioning, dimensioning, or both, of the orifice region is selected so that the orifice cross section is not open toward the third cavity in any position of the second component within the range of displacement.

11. The cooling arrangement as claimed in claim 1, wherein the first component, the second component, and the wall extend annularly relative to a common longitudinal center axis;

wherein the wall separates the first cavity axially from the second cavity;

wherein the second cavity separates the first cavity radially from the third cavity;

wherein the second component is radially displaceable relative to the first component; and wherein the cooling-gas passage opens into the first cavity in the region of an outer side, lying radially on the outside, of the second component.

12. The cooling arrangement as claimed in claim 1, wherein the first cavity comprises a cavity in a gas turbine of a power plant.

13. A cooling arrangement for the admission of a cooling gas to a first cavity, comprising:

a first cavity, a second cavity spaced from the first cavity, and a third cavity spaced from the first cavity;

a first component having a wall separating the first cavity from the second cavity, the wall having a bearing side;

at least one cooling-gas passage arranged in said wall and communicatingly connecting the first cavity to the second cavity;

a second component bearing against the wall on the bearing side remote from the second cavity and separating the first cavity from the third cavity;

the second component being displaceable along the wall within a predetermined range of displacement;

the at least one cooling-gas passage including an orifice region facing the first cavity dimensioned, positioned, or both, so that an orifice cross section projects from the range of displacement at least to such an extent that the orifice region is open at least with a predetermined minimum cross section in any position of the second component within the range of displacement;

wherein the first component, the second component, and the wall extend annularly relative to a common longitudinal center axis;

wherein the wall separates the first cavity axially from the second cavity;

wherein the second cavity separates the first cavity radially from the third cavity;

wherein the second component is radially displaceable relative to the first component;

wherein the at least one cooling-gas passage opens into the first cavity in the region of an outer side, lying radially on the outside, of the second component;

wherein said at least one cooling-gas passage comprises at least two cooling-gas passages;

a circumferentially extending, axially open groove formed in the wall on the bearing side, the groove connecting the at least two cooling-gas passages to one another so that the orifice regions of said cooling-gas passages are formed by the groove or merge into the groove; and wherein a plurality of circumferentially distributed cooling-gas passages are formed in the wall.

* * * * *